United States Patent [19]

Martin

[11] 4,120,502

[45] Oct. 17, 1978

[54] GOLF GAME APPARATUS

[75] Inventor: William H. Martin, Guelph, Canada

[73] Assignee: The Raymond Lee Organization, Inc., New York, N.Y. ; a part interest

[21] Appl. No.: 816,647

[22] Filed: Jul. 18, 1977

[51] Int. Cl.[2] ..... A63B 69/36

[52] U.S. Cl. ..... 273/176 R; 273/176 L; 273/184 B

[58] Field of Search ..... 273/176 R, 176 L, 176 FA, 273/185 A, 185 B, 185 C, 185 D, 184 B, 184 R

[56] References Cited

U.S. PATENT DOCUMENTS

| | | | |
|---|---|---|---|
| 1,677,557 | 7/1928 | Johnson | 273/184 B |
| 2,121,750 | 6/1938 | Vaughan | 273/176 L |
| 2,462,507 | 2/1949 | Klyver | 273/176 R |
| 2,641,933 | 6/1953 | Van Kinkle | 273/184 B |
| 3,309,927 | 3/1967 | Ferranti | 273/185 A X |
| 3,617,064 | 11/1971 | Collup | 273/176 R |

*Primary Examiner*—George J. Marlo
*Attorney, Agent, or Firm*—Howard I. Podell

[57] ABSTRACT

An apparatus is constructed utilizing electromechanical devices only, for use as a game apparatus, whose rules of operation imitate those of golf, and whose action is responsive to skill of the operator. The apparatus is formed of a display unit on which a simulated golf ball travels a distance over a display of a golf course in response to the striking by a user with a golf club of a captive golf ball mounted on a driving range unit of the device. The simulated golf ball is mounted to a belt that is driven by a first motorized unit at a fixed speed of travel and for a period of time controlled by a momentum device connected by a flexible cable to a pivoted lever fixed to the captive golf ball.

4 Claims, 7 Drawing Figures

GOLF GAME APPARATUS

BACKGROUND OF THE INVENTION

There are patents which disclose various structures for accomplishing a similar purpose but employing apparatus that does not suggest the electro-mechanical assemblies devised by the applicant for accomplishing the purpose.

SUMMARY OF THE INVENTION

My invention is an apparatus constructed utilizing electromechanical devices only, for use as a game apparatus, whose rules of operation imitate those of golf, and whose action is responsive to skill of the operator. The apparatus is formed of a display unit on which a simulated golf ball travels a distance over a display of a golf course in response to the striking by a user with a golf club of a captive golf ball mounted on a driving range unit of the device. The simulated golf ball is mounted to a belt that is driven by a first motorized unit at a fixed speed of travel and for a period of time controlled by a momentum device connected by a flexible cable to a pivoted lever fixed to the captive golf ball.

The momentum device incorporates a second motorized unit that rotates a threaded shaft, with a bracket member loosely riding on the threaded shaft that is attached to the pivoted lever of the captive golf ball. In the neutral condition, the bracket member is held against a limit switch, to hold the switch in the open position, with the switch in series with both motorized units. When the captive ball is struck to displace the lever and the bracket, the limit switch is actuated to energize both motors, with the rotation of the threaded shaft drawing the bracket towards the limit switch to cause it to open when the neutral position is reached.

BRIEF DESCRIPTION OF THE DRAWINGS

The objects and features of the invention may be understood with reference to the following detailed description of an illustrative embodiment of the invention, taken together with the accompanying drawings in which.

Figure 1:
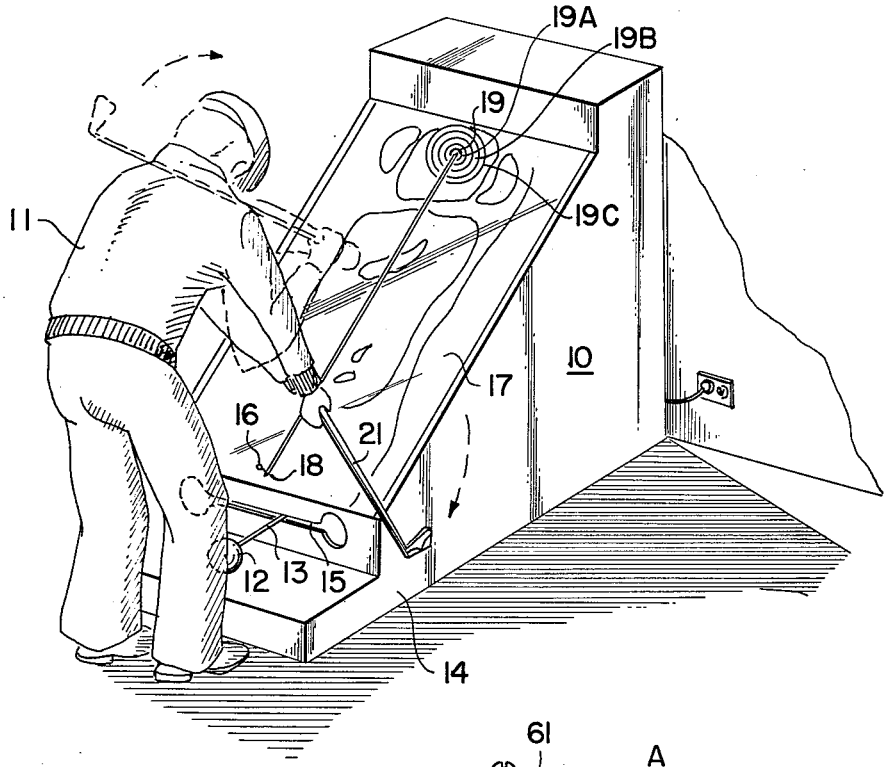
FIG. 1 is a perspective view of the invention, in use.

DESCRIPTION OF THE PREFERRED EMBODIMENT:

Turning now descriptively to the drawings, in which similar reference characters denote similar elements throughout the several views, FIG. 1 illustrates the apparatus 10, with a player 11 about to strike with a club 21 a captive golf ball 12 fixed to a lever 13 projecting from the housing 14 through a horizontal slot 15. An indicator ball 16 mounted over a pictorial display 17 travels upward from the tee section 18 to the displayed golf hole 19 a distance based on the impact force of club 21 against captive ball 12.

As will be described herein, if the captive golf ball is struck with a first given force, the indicator ball 16 will reach and stop at the hole 19, for a hole-in-one. If the ball 12 is struck with a lesser force, the indicator ball will stop short of hole 19 and the captive ball 12 may be restruck to putt the indicator ball to the hole 19. If the ball 12 is at any time struck with a force greater than that required to reach the hole 19, the indicator ball will reach hole 19 and then travel back towards the tee by a distance proportional to the excessive force applied to ball 12. A push button switch E may be manually actuated to return the indicator ball 16 to the tee section 18 of the display, after it has stopped travelling. Should ball 12 be struck with such excessive force that the indicator ball 16 reverses course and returns to tee 18, it will reverse course at tee 18 and travel back towards hole 19.

Figure 2:
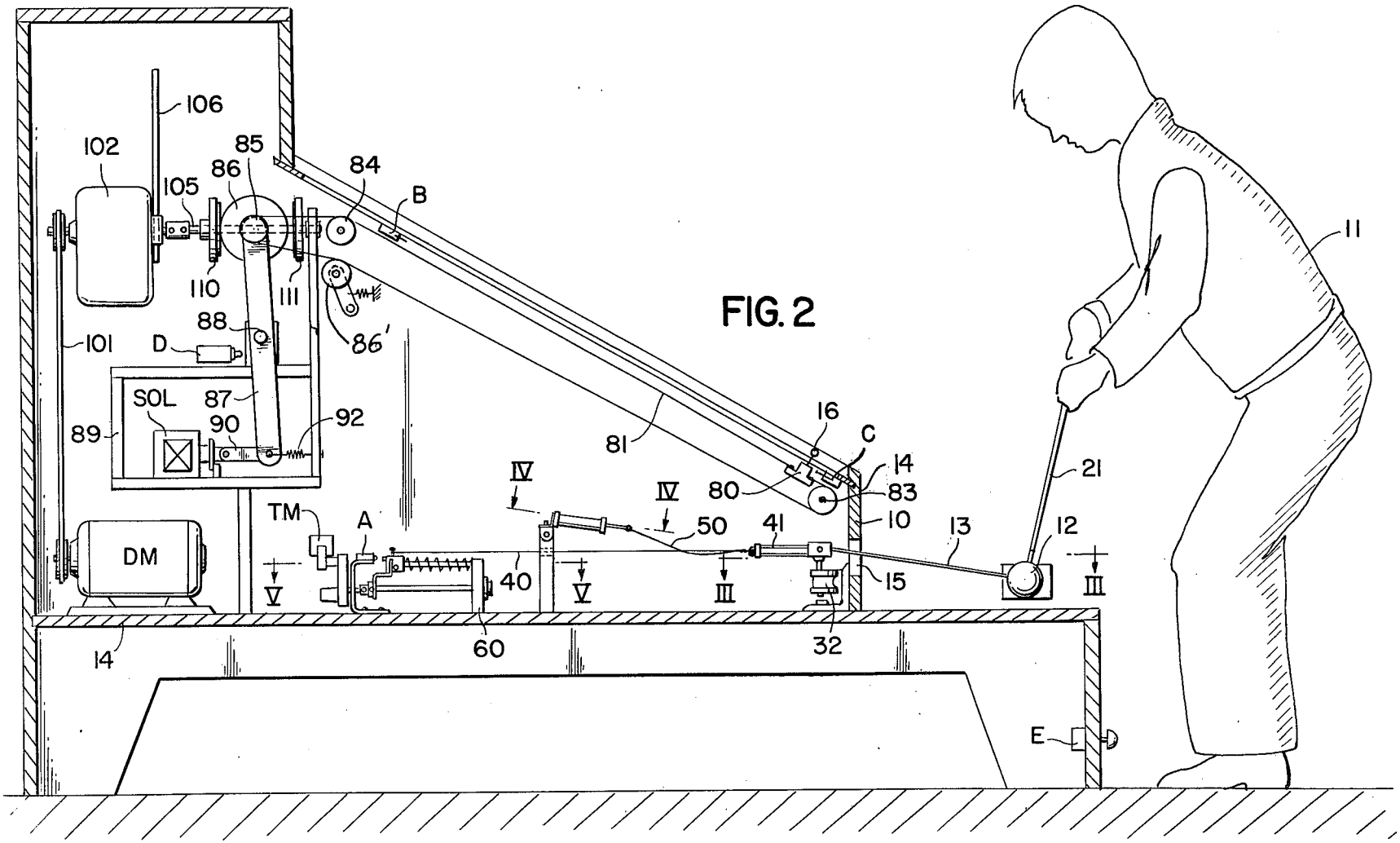
FIG. 2 is a side sectional view of the invention.
Figure 3:
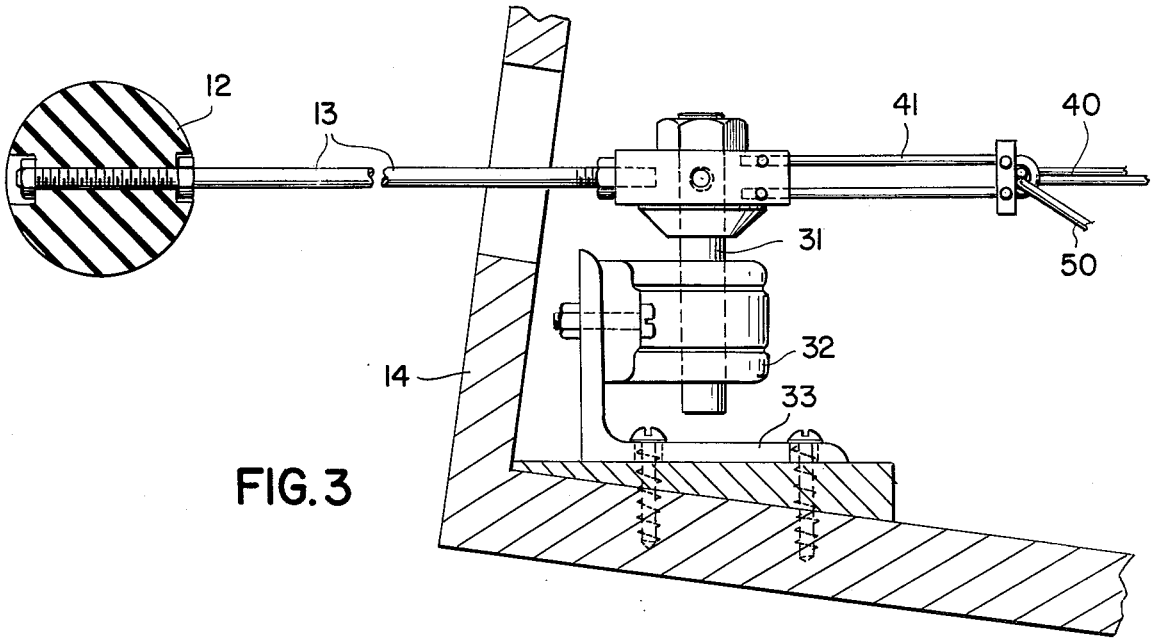
FIG. 3 is a detail section view of the invention, taken along line III—III of FIG. 2.
Figure 4:
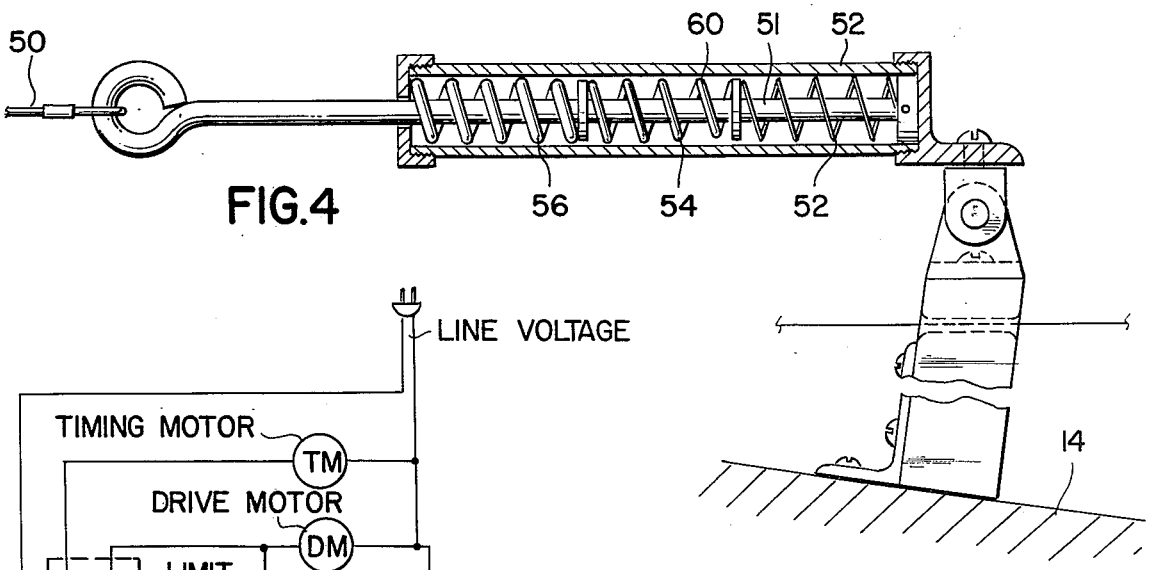
FIG. 4 is a detail section view of the invention, taken along line IV—IV of FIG. 2.

FIGS. 2 and 3 illustrate the lever 13 fixed to a vertical shaft 31 rotatably mounted in a bearing 32 mounted on a bracket 33 fixed internally to housing 14. A first tension cable 40 and a second tension cable 50 fixed to an arm unit 41 radially mounted to shaft 31. Cable 50 is fixed at its opposed end to a piston shaft 51 mounted in a cylinder 52 fixed to housing 14, with a spring assembly 60 mounted about piston shaft 51 to bias cable 50 away from lever 13 and arm unit 41, with spring assembly 60 formed of three compression springs 52, 54, and 56 mounted in series configuration and with each spring 52, 54, 56 of a different flexural strength. The spring assembly 60 provides the reaction force to the rotation of lever 13 when ball 12 is struck by a club 21 to limit the rotation of lever 13 in proportion to the striking force of club 21 against ball 12.

Figure 6:
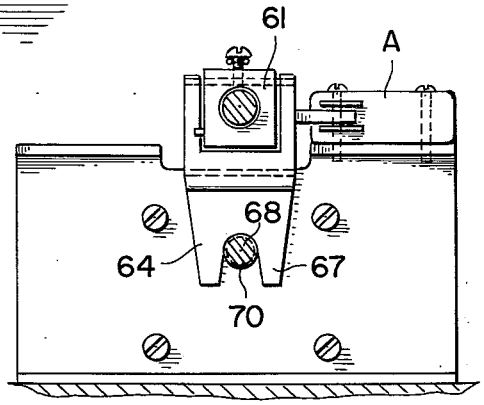
FIG. 6 is a detail section view of the invention, taken along line VI—VI of FIG. 5.
Figure 5:
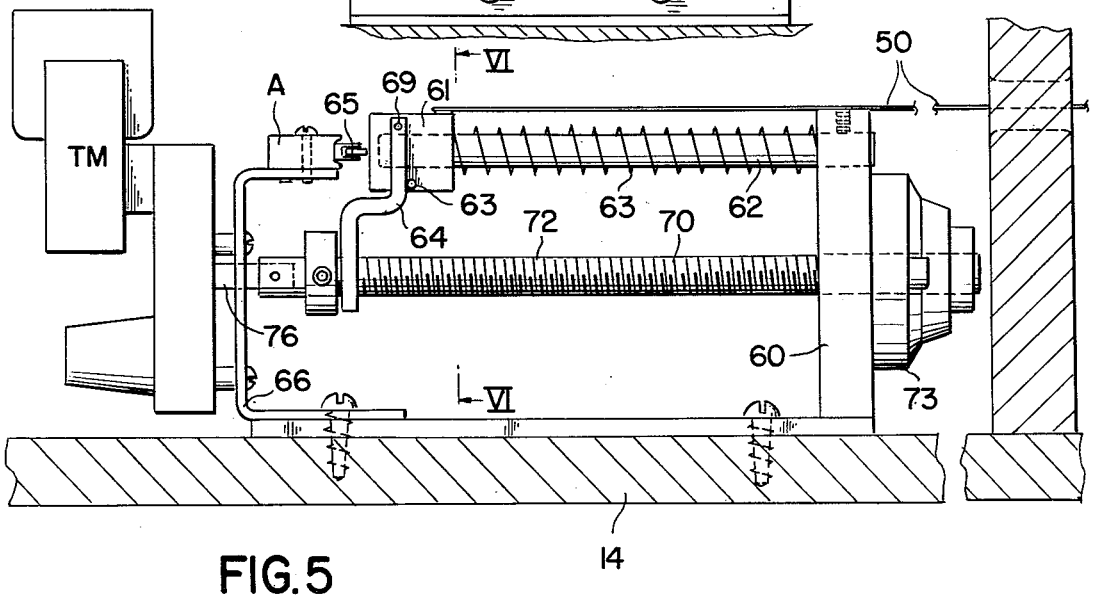
FIG. 5 is a detail section view of the invention, taken along line V—V of FIG. 2.

Cable 40 leads to the governing central unit 60 shown in FIGS. 2, 5 and 6 to fasten to a governor block 61 freely slidably mounted on a fixed shaft 62, with a compression spring 63 on fixed shaft 62 biasing block 61 leftwards to the neutral position shown in which block 61 contacts the actuator 65 of double-pole double-throw limit switch A mounted on a bracket 66 fixed to housing 14. An extension leg 64 fixed to block 61 extends about a rotatable shaft 70, the external surface of which is formed with a screw thread 72, with rotatable shaft 70 rotatably mounted at the right end in bearing 73 and fixed at the left end to drive shaft 76 of a geared timing motor TM fixed to bracket 66. Leg 64 of block 61 terminates in a forked section 67 with midsection 68 of which is formed with a female thread to freely engage screw threaded part 72 of shaft 70. Leg 64 is pivotally mounted to block 61 by pin 69, with detent 63 on block 61 serving as a stop to limit counterclockwise rotation of leg 64 relative to block 61, but permitting clockwise rotation so that when block 61 is pulled by cable 50 away from the neutral position and from switch A, leg 64 will freely travel over the threaded surface of shaft 70.

Switch A, when free of contact with block 61, energizes timing gear motor TM to cause shaft 70 to rotate in a direction so as to cause threads 72, bearing against the leg 64, to draw the leg 64 and block 61 back to the neutral position, and contact switch A to deenergize the motor TM, with the time period of the cycle dependent upon the initial distance block 61 was pulled by cable 50 from the netural position in response to the rotation of lever 13 of captive ball 12.

Switch A, when disengaged from block 61, with block 61 away from the neutral position also independently actuates drive motor DM to cause indicator ball 16 to travel for the period of the cycle.

Indicator ball 16 is fixed to a transfer 80 fixed at each end of an endless cable 81 looped over tee idler pulley 83, hole idler pulley 84, drive pulley 85 and tension idler pulley 86. Drive pulley 85 is fixed to clutch pulley 86 pivotally mounted to solenoid lever 87. Solenoid lever 87 is pivotally mounted to pin 88 fixed to frame 89 internally fixed to housing 14, with solenoid lever 87 pivotally mounted to solenoid arm 90 of solenoid SOL. A tension spring 92 biases lever 87 and arm 90 away from the solenoid. A limit switch D is mounted on frame 89 to be actuated by lever 87 when the solenoid is energized.

Drive motor DM is linked by a cable 101 to the input shaft of a variable speed converter 102, with the output shaft of the converter 102 fixed to a rotatable shaft 105. The ratio of the input to output speeds of the converter 102 are adjusted by arm 106.

A pair of spaced clutch plates 110 and 111 are fixed to shaft 105, on alternate radial sides of clutch pulley 86 and spaced so that in the OFF position of solenoid SOL, spring 92 biases clutch pulley 86 into peripheral contact with the inner face of clutch plate 110 while the ON position of the solenoid rotates lever 87 to cause clutch pulley 86 to contact the inner face of plate 111. In the OFF position of solenoid SOL, clutch pulley 86 is rotated to cause indicator ball 16 to travel towards the golf hole and towards limit switch B, while in the ON position, clutch pulley 86 rotates in the reverse direction to cause indicator ball 16 to travel towards the tee position and towards limit switch C.

Figure 7:
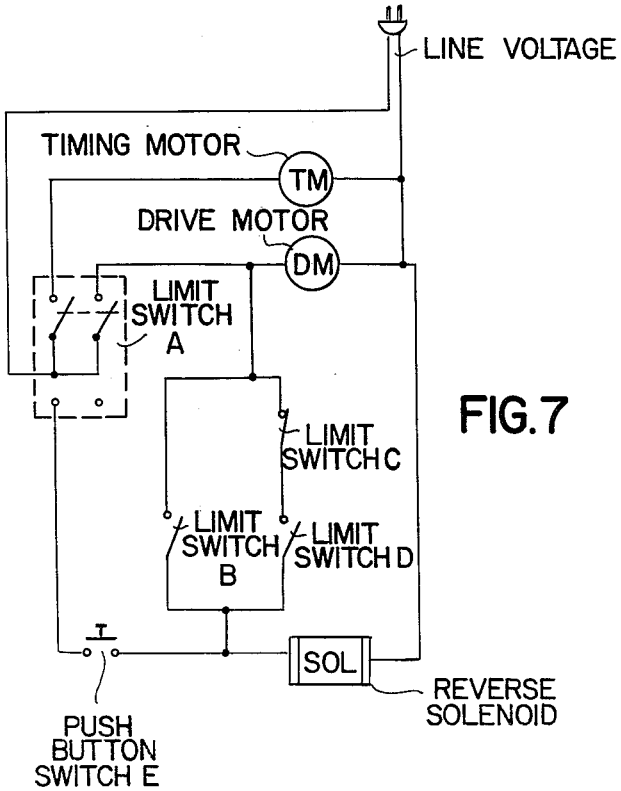
FIG. 7 is a schematic view of the electrical circuit of the invention.

As shown in FIG. 7, limit switch A is shown in the normal position disengaged from governor block 61 to actuate the timing motor TM and the drive motor DM, with solenoid SOL deenergized. Momentary actuation of limit switch B, by traveler 80 causes solenoid SOL to be actuated, and to close limit switch D effecting the reversal of direction of travel of the indicator ball. Should the indicator ball 16 reach the tee, when travel is reversed, limit switch C will open to open the holding circuit of the solenoid, causing the indicator ball to travel back towards the hole. Upon governor block, driven by timing motor TM, reaching the neutral position, switch A opens the circuit to both motors TM and DM.

Manual operation of push button switch E energizes solenoid SOL, in the engaged position of switch A, (the neutral position of governor block 61) and also energizes through switch D, the drive motor to cause the indicator ball to return to the tee position, whereupon limit switch C is opened to stop drive motor DM.

The apparatus of the invention is particularly designed for use in a public amusement game, for the playing of simulated golf by the general public.

It is so designed that anyone capable of swinging a golf club in a any manner at all will be able to reproduce the result of a golf shot through the movement of a small ball on a picture of a golf hole.

In playing my game which I call "Maxi-Golf", the player will stand on a platform on a rubber mat. Protruding from the cabinet on flexible pivotting rod lever 13 is a captive ball 12. Underneath the captive ball, a resilient mat is placed to absorb the shock of hitting behind or below the captive ball. The captive ball may be about the size of a tennis ball, and made of soft rubber.

Golf club 21 is similar in length and weight to a regulation golf club except for a larger head.

The club 21 can be a right-hand or left-hand golf club. To start playing the player drives the captive ball using full force as in the playing of regulation golf. The impact of the drive on the captive ball is automatically calibrated and translated into the travel of the indicator ball 16 up the fairway of the hole. When the indicator ball stops, it will show how many yards the player would have driven the ball on a golf course. The pictured hole is marked off in yards, so that the player can mentally deduct the length of the drive from the length of the hole in order to ascertain the length of his next shot. Assuming there is less than a full shot remaining to reach the green he must then try to judge how hard to hit the captive ball in order to make the indicator ball 16 stop on the green.

The indicator ball 16 moves quite slowly up the pictorial display 17 so that the player can watch its progress towards or over the various pictured hazards. Should the indicator ball 16 stop at a pictured hazard, a penalty stroke is added to the score. When the indicator ball 16 reaches the putting green the player has an option. The green is marked with concentric circles in bulls-eye fashion. The smallest inner circle 19A is marked "Holed Out". The next larger circle 19B is marked "One Putt Area" and the outer most circle 19C, marked "2 Putt Area". If outside the outer circle 19C, the captive ball must be putted, but the player has the option of claiming one putt or two putts if the ball lies within the bull's eye or to putt out as in regulation golf, since he possibly could save a stroke by holing out in one stroke from the 2 putt area.

In playing a shot to the green the captive ball will often be struck hard enough to over play the green. When this occurs, the indicator ball on reaching the center of the green immediately reverses its direction and moves back in the direction of the driving tee position and will stop exactly as far back down the fairway as it would have gone beyond the green. Play then continues.

The only manual control required is the push button switch E which returns the indicator ball back to the driving tee position when the hole is completed.

It is proposed to set out 9 or 18 of these units in much the same fashion as was a miniature golf course. They would occupy the similar amount of space and each unit would have a different pictorial display. Maxi-Golf can be played outdoors as well as indoors.

Since obvious changes may be made in the specific embodiment of the invention described herein, such modifications being within the spirit and scope of the invention claimed, it is indicated that all matter contained herein is intended as illustrative and not as limiting in scope.

Having thus described the invention, what I claim as new and desire to secure by Letters Patent of the United States is:

1. An apparatus for simulating the play of gold comprising a display unit on which an indicator is mounted to travel from a start position to a finish position and a drive unit which incorporates a captive ball mounted to the apparatus together with electro-mechanical means to cause the indicator to travel a distance related to the impact force with which the captive ball is struck, said electro-mechanical means including first electro-mechanical means to translate the impact force against the captive golf ball into a measured time period which is proportioned to said impact force and a second electro-mechanical means to drive the indicator for the duration of said time period.

2. The combination as recited in claim 1 in which the said first electro-mechanical means comprise a slidable block slidably engaged with a threaded shaft, said block biased by a spring towards a first position in which the block engages a limit switch and fastened to a tension member which is linked to a pivotable member that is fastened to the captive ball, such that movement of the captive ball away from a neutral position causes the tension member to pull the block away from the limit switch, said threaded shaft fixed to the drive shaft of a first gear motor, with said limit switch connected to actuate said first gear motor when the block is disengaged from the said limit switch, said motor revolving said shaft so as to cause the threads of said shaft to draw the block towards the limit switch.

3. The combination as recited in claim 2 in which the said second electro-mechanical means includes a second gear motor mounted to a drive mechanism linked to the indicator, said gear motor connected to said limit switch so as to be energized when the block is disengaged from the said limit switch.

4. The combination as recited in claim 3 together with means means to reverse the direction of travel of the drive mechanism of the indicator.

* * * * *